US006672485B2

(12) United States Patent
Mascitelli

(10) Patent No.: US 6,672,485 B2
(45) Date of Patent: Jan. 6, 2004

(54) METERING DEVICE FOR FLUID PRODUCTS

(75) Inventor: Francesco Mascitelli, San Giovanni Teatino (IT)

(73) Assignee: Emsar S.p.A., S. Giovanni Teatino (CH)

( * ) Notice: Subject to any disclaimer, the term of this patent is extended or adjusted under 35 U.S.C. 154(b) by 0 days.

(21) Appl. No.: 09/980,208

(22) PCT Filed: Mar. 30, 2001

(86) PCT No.: PCT/IT01/00165

§ 371 (c)(1),
(2), (4) Date: Nov. 30, 2001

(87) PCT Pub. No.: WO01/74496

PCT Pub. Date: Oct. 11, 2001

(65) Prior Publication Data

US 2002/0162861 A1 Nov. 7, 2002

(30) Foreign Application Priority Data

Mar. 31, 2000 (IT) ..... RM2000A0162

(51) Int. Cl.[7] ..... B67D 5/42
(52) U.S. Cl. ..... 222/207; 222/383.1
(58) Field of Search ..... 222/207, 383.1

(56) References Cited

U.S. PATENT DOCUMENTS

| | | | | |
|---|---|---|---|---|
| 2,815,890 A | * | 12/1957 | Coopvider | 222/207 |
| 2,853,210 A | | 9/1958 | Stewart et al. | |
| 2,879,924 A | | 3/1959 | Bacheller | |
| 2,884,164 A | | 4/1959 | Kleid | |
| 3,753,518 A | * | 8/1973 | Kutik | 222/207 |
| 3,785,532 A | | 1/1974 | Cooprider | |
| 3,910,458 A | | 10/1975 | Ewald | |
| 3,948,420 A | | 4/1976 | Humphrey | |

* cited by examiner

*Primary Examiner*—Kenneth Bomberg
(74) *Attorney, Agent, or Firm*—Browdy and Neimark, P.L.L.C.

(57) ABSTRACT

A metering device for fluid products, having a pump body equipped with suction tube and applied by means of a cap to a bottle or the like containing a fluid product to be dispensed, an elastically deformable pushbutton, applied superiorly to the pump body and defining therewith a metering chamber provided with a n intake valve and an exhaust valve, a dispenser mounted on the cap and provided with a spout comprising a conduit for the emission of the content of the bottle communicating with the intake valve, at least a compensation channel, which replaces the extracted fluid with air coming from the exterior, provided, in said dispenser, pushbutton and pump body.

8 Claims, 5 Drawing Sheets

X
VIII

METERING DEVICE FOR FLUID PRODUCTS

REFERENCE TO RELATED APPLICATION

The present application is the national stage under 35 U.S.C. 371 of international application PCT/IT01/00165, filed Mar. 30, 2001 which designated the United States, and which international application was published under PCT Article 21(2) in the English language.

TECHNICAL FIELD

The present invention relates to a metering device or dispenser for fluid products, of the type operating like a manually operating reciprocating volumetric pump.

BACKGROUND ART

A wide variety of dispenser devices of this kind, applied to bottles or the like containing a fluid product to be dispensed for use, already exists. They comprise a metering chamber with variable volume, provided with an intake valve and a delivery or expulsion valve. The fluid product to be dispensed is aspirated from the bottle into the metering chamber, when the volume of the chamber increases and is expelled when the volume of the chamber decreases. The variation in the volume of the metering chamber is obtained by means of components in relative motion, generally an operating pushbutton, a stem and a piston, comprising, together with check intake and delivery valves, a dispenser.

The closure of the traditional dispensing device is obtained by means of its rotation on the neck of the bottle whereon it is applied.

This type of dispenser functions in a satisfactory manner, allowing for generally accurate metering. However, the high number of components, commonly eleven or twelve, whereof it is constituted, the complexities of these parts, together with their difficulty of assembly, make the traditional dispensing device not suitable for a reduction of its cost below a certain level.

DISCLOSURE OF INVENTION

The present invention intends to overcome the aforementioned drawbacks.

An aim of the present invention is to obtain a metering device having a reduced number of components.

Another aim of the invention is to avoid, in a metering device, components in relative motion which would increase its complexity of fabrication and assembly.

A further aim of the invention is to obtain a metering device that is simpler also in its utilisation, thanks to ergonomic characteristics connected with the lack of parts in relative motion.

Yet another aim of the invention is to obtain a metering device at a reduced fabrication cost.

Therefore, the present invention provides a metering device for fluid products, of the type operating as a manually operated reciprocating volumetric pump having a pump body, provided with suction tube and applied by means of a cap to a bottle or the like containing a fluid product to be dispensed, which from a general point of view, is characterised in that it operates like a reciprocating membrane volumetric pump comprising:

an elastically deformable pushbutton, applied superiorly to the pump body and defining therewith a metering chamber provided with an intake valve from the interior of the bottle and an expulsion or delivery valve towards the exterior of the bottle;

a dispenser, mounted on said cap and provided with a spout comprising a conduit for emitting the content of the bottle communicating with the delivery valve;

at least a compensation channel, which replaces the extracted fluid with air coming from the exterior, provided externally to said metering chamber and to said emission conduit, in said dispenser, pushbutton and pump body for communication between the exterior and the interior of the bottle.

DESCRIPTION OF THE DRAWINGS

Further features and advantages of the invention shall become more readily apparent from the detailed description that follows of a preferred embodiment illustrated provided purely by way of non limiting indication in the accompanying drawings, in which.

DESCRIPTION OF THE ILLUSTRATIVE EMBODIMENT

Figure 2:
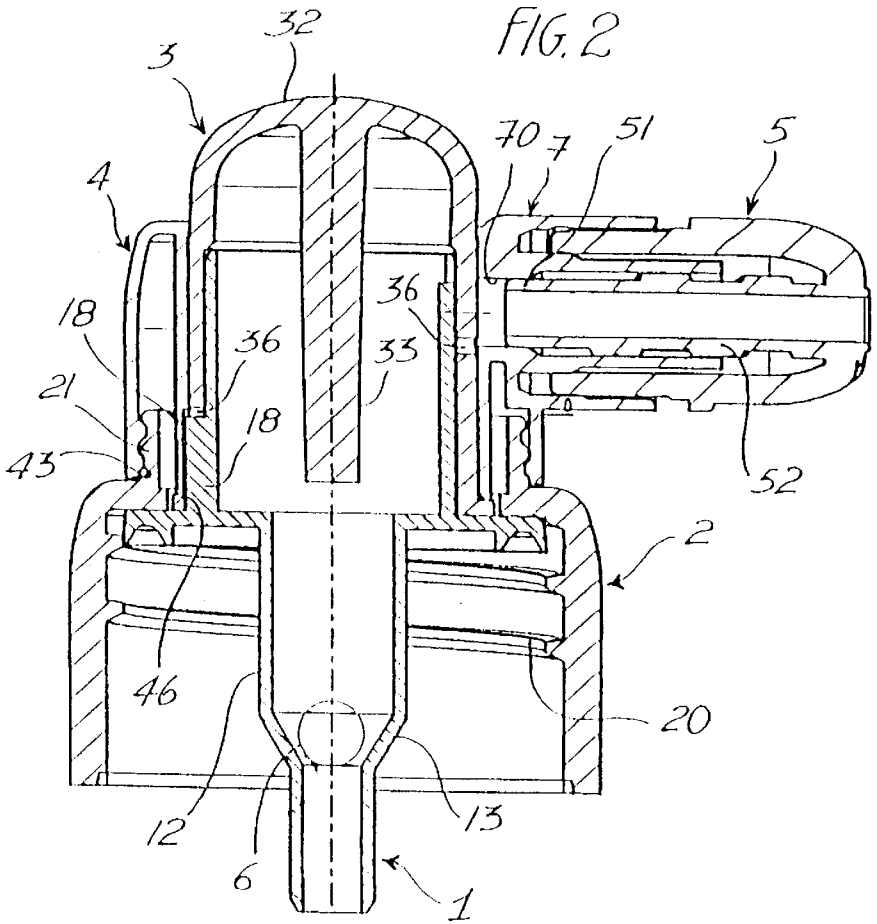
FIG. 2 is a section obtained according to a line II—II in FIG. 1.
Figure 1:
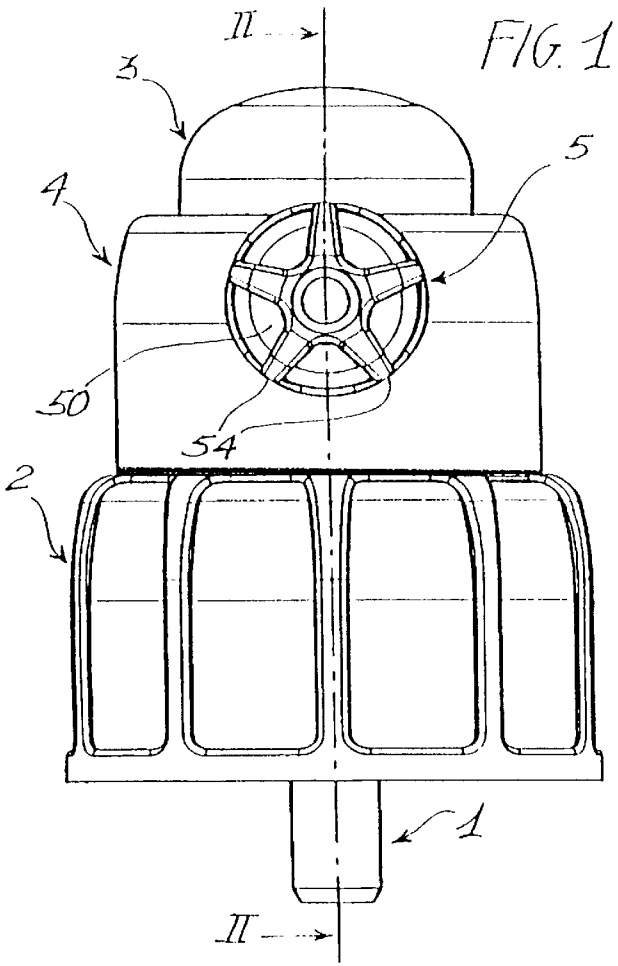
FIG. 1 is a global front view of a metering device according to the present invention.

With reference to FIGS. 1 and 2, a global aspect of the metering device according to the invention is shown. It comprises a pump body 1, a cap 2 for mounting to a bottle or the like (not shown), a pushbutton 3, a dispenser 4 and a closure tip 5.

Figure 3:
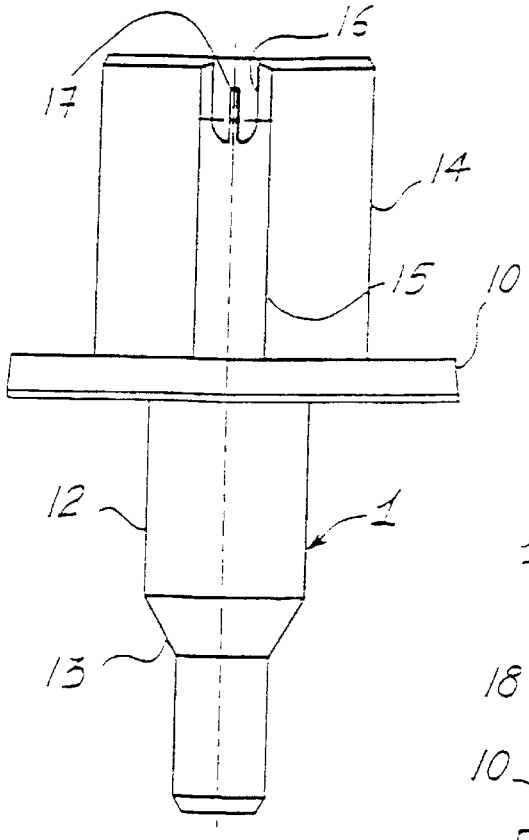
FIG. 3 is a front view of a pump body of the metering device of FIG. 1.
Figure 5:
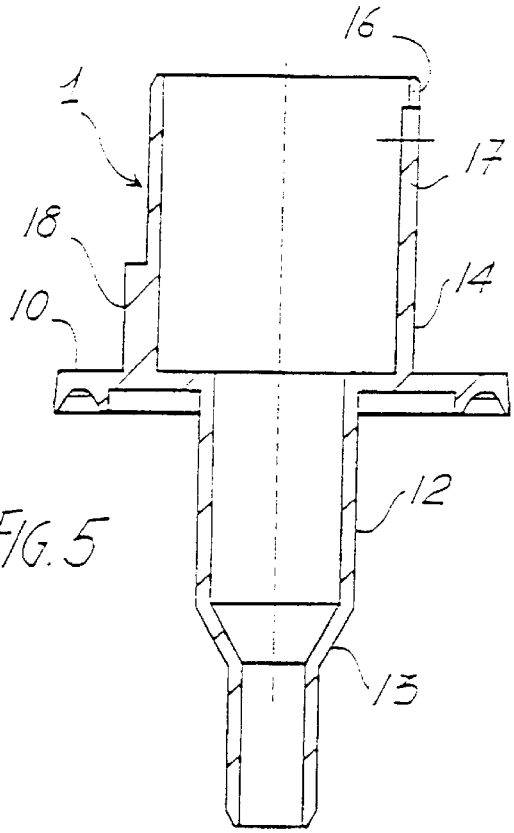
FIG. 5 is a section obtained according to the line V—V of FIG. 4.
Figure 4:
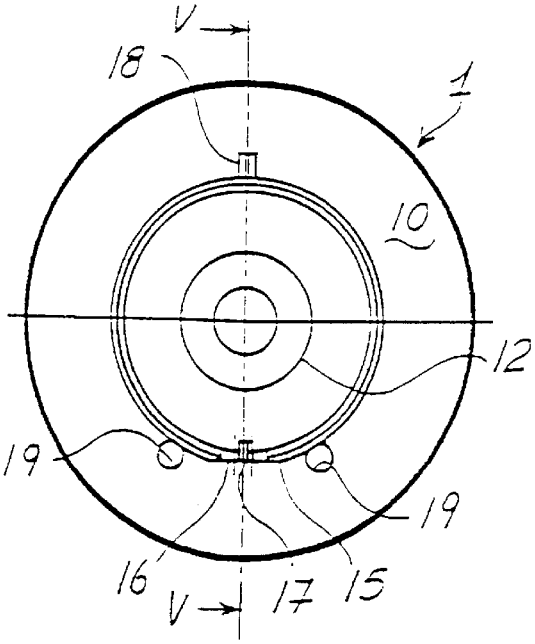
FIG. 4 is a top plan view of the pump body of FIG. 3.

With reference to FIGS. 3 through 5, which are front, plan and, respectively, section views, the pump body 1 is shown. It is made of a plastic material, preferably a polypropylene based homopolymer.

The pump body 1 comprises a flanged plate 10 whose lower side is destined to bear on the edge of the bottle or the like. On the same side as the flanged plate 10 is located, in central position, a tubular union 12 for the suction tube (not show). It presents a cone frustum shaped portion 13 as a valve seat and a ball shutter 6 (FIG. 2) to create an intake valve, as shall become readily apparent farther on.

Coaxially with the tubular union 12, on the opposite side of the flanged plate 10, there is a cylindrical element 14 destined to receive the pushbutton 3. The cylindrical element 14 has a squared external lateral portion 15, terminating superiorly with an omega shaped louver 16. The louver 16, which delimits a small abutting vertical stem 17, is part of an intake valve, as shall be described farther on.

On the outer lateral surface of the cylindrical element 14, for instance on the side opposite to the squared lateral portion 15, is also provided a longitudinal centering projection 18. Lastly, on the flanged plate 10 are obtained, at the sides of the squared portion 15, through holes 19, 19 comprised in respective compensation channels, as shall be described farther on.

The pump body 1 is mounted on the bottle by means of the cap 2 (FIGS. 2, 12) which is provided with an interior thread 20 for its screw-on coupling with the bottle, and a pair of external undercuts 21 for the coupling of the dispenser 4 therewith. The cap 2 is made of a plastic material, preferably a polypropylene based copolymer.

Figures 6, 7, 8, 9, 10:
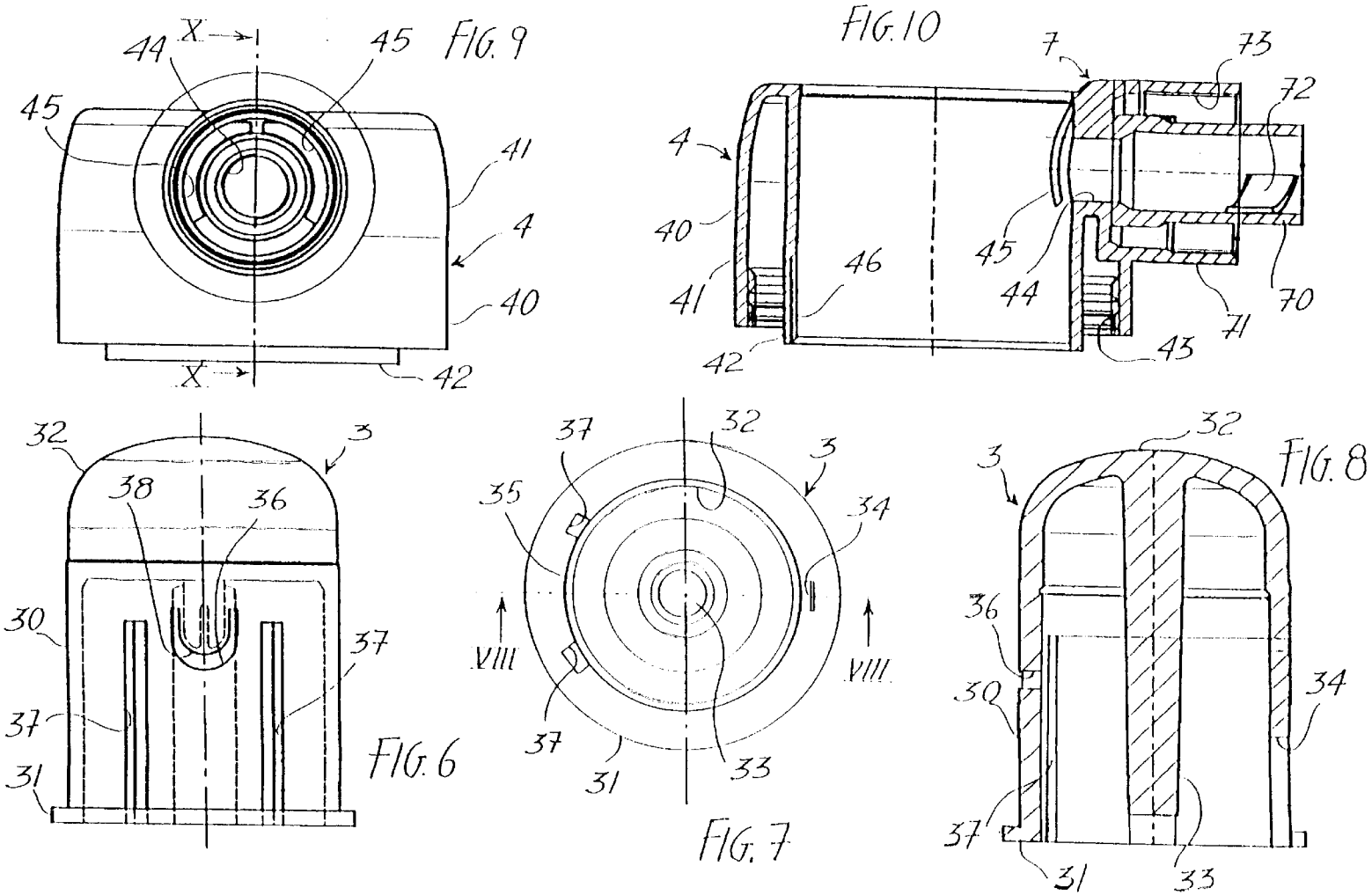
FIG. 6 is a front view of a pushbutton of the metering device of FIG. 1.
FIG. 7 is a bottom plan view of the pushbutton of FIG. 6.
FIG. 8 is a section obtained according to the line VIII—VIII of FIG. 7.
FIG. 9 is a front view of a dispenser of the metering device of FIG. 1.
FIG. 10 is a section obtained according to the line X—X of FIG. 9.

On the pump body 1 is mounted the pushbutton 3, shown in FIGS. 6 through 8 respectively in front, bottom plan, and, respectively, in longitudinal section views. The pushbutton 3 is made of plastic material, preferably a thermoplastic polymer.

Figure 11:
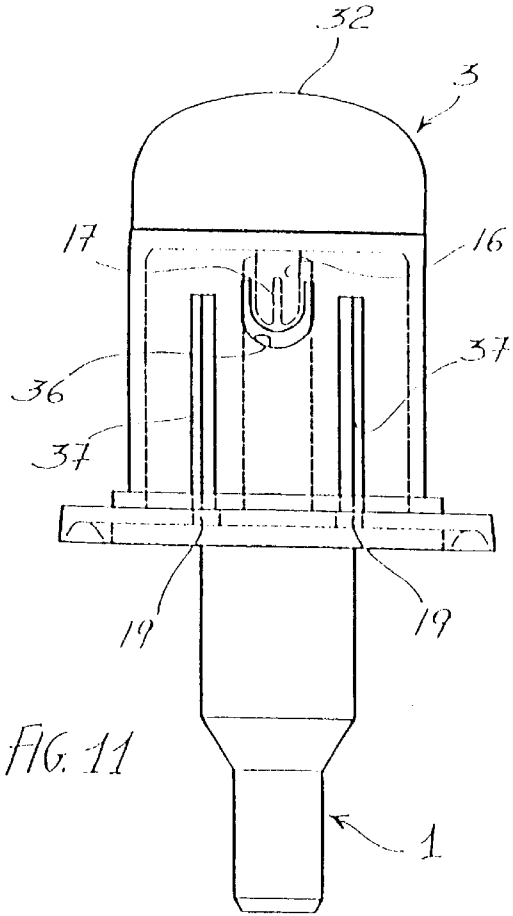
FIG. 11 is a global front view of the body and of the pushbutton of FIGS. 3 through 8.
Figure 13:
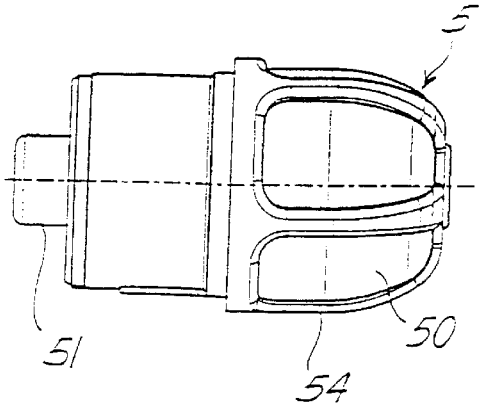
FIG. 13 is a lateral view of a closure tip of the metering device of FIG. 1.
Figure 14:
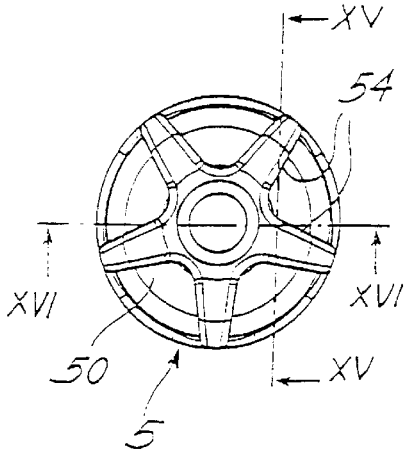
FIG. 14 is a front view of the closure tip of FIG. 13.
Figure 15:
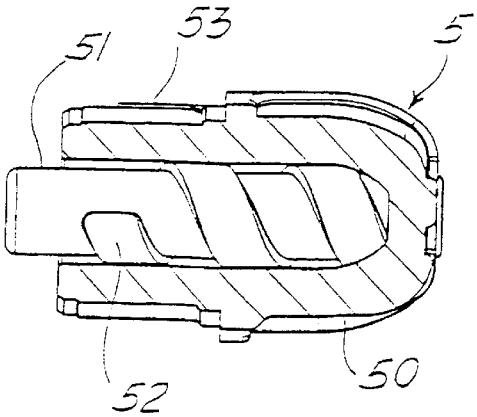
FIG. 15 is a section obtained according to the line XV—XV of FIG. 14.
Figure 16:
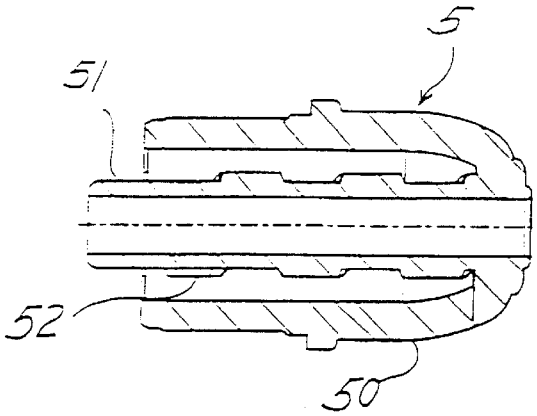
FIG. 16 is a section obtained according to the line XVI—XVI of FIG. 14.

The pushbutton 3 is cupola shaped and comprises a cylindrical wall 30, provided at its base with a flange 31, and a spherical dome 32 provided internally with retaining stem 33 integral with the top of the dome, substantially central. As shown in FIGS. 7 and 8, the pushbutton 3 has in the cylindrical wall 30 a longitudinal centering slot 34 corresponding to the centering projection 18 of the pump body 1, which occupies it during mounting operations. At the side opposite the centering slot 34, in the cylindrical wall 30 is obtained an internally squared portion 35, corresponding to the external squared portion 15 of the pump body 1. In the top part of the internal squared portion 35 is obtained a U shaped cut 36, which faces, when the metering device is mounted (FIG. 11), the omega shaped louver 16 of the pump body 1. The U shaped cut 36, which creates a tongue 38 in the pushbutton 3, and the omega shaped louver 16 constitute a delivery valve, as shall become readily apparent farther on.

At the sides of the squared portion 35 are obtained two parallel slots 37, 37 oriented according to the generatrix of the cylindrical wall 30 comprised in the compensation channels, as shall become readily apparent farther on.

Figure 12:
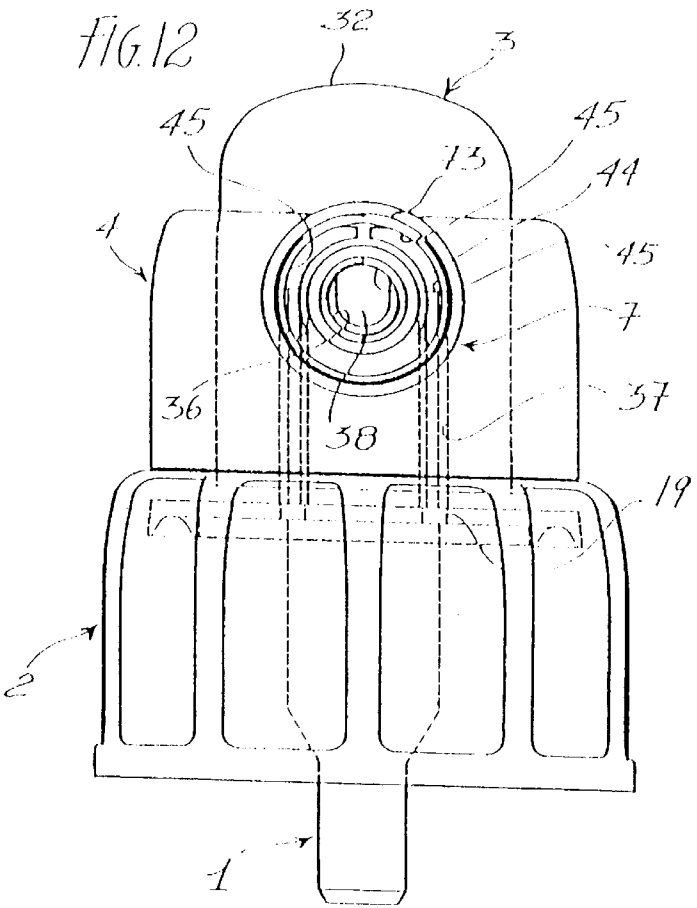
FIG. 12 is a global front view of the body, of the pushbutton and of the dispenser of FIGS. 3 through 10.

As shown in FIGS. 2 and 12, the pushbutton 3 is held on the pump body by means of the dispenser 4. The dispenser 4 has a sleeve portion 40, formed by an outer cylindrical wall 41 and by an opposite inner cylindrical wall 42. In a position of internal extremity of the outer cylindrical wall 41 are obtained two under cuts 43 for the attachment of the cap, which allow its free and continuous rotation. Laterally, substantially in perpendicular fashion, in the sleeve 40 is obtained, in a single piece, a spout 7 communicating with the interior of the inner cylindrical wall 42 by means of a through hole 44 and at least a "C" shaped notch 45 (a pair of notches 45, 45 is preferable), as shown in FIGS. 10 and 12. On the internal side of the inner cylindrical wall 42 a centering groove 46 is also provided.

The spout 7 is sleeve shaped, comprising an emission conduit 70 and a coaxial tubular element 71, which constitutes a second conduit communicating with at least a notch 45. In the spout 7 is inserted a fusiform closure tip 5 (FIG. 2), shown in the various views in FIGS. 13 through 16. The closure tip 5 itself has a sleeve shape, substantially symmetrical, although offset, relative to the spout 7, having a fusiform body 50 surrounding a longitudinal tubular core 51. A male-female coupling takes place between tubular core 51 and emission conduit 70 and between fusiform body 50 and tubular element 71 of the spout 7.

The emission conduit 70 presents an interior thread 72 (FIG. 10) whereon is destined to be screwed the tubular core 51 of the closure tip 5 with its exterior thread 52.

The closure tip 5 presents, on the fusiform outer profile 50, at least an external stop projection 53 destined to be engaged by abutting against at least a corresponding internal stop projection 73 (FIG. 10) provided on the coaxial tubular element 71. The presence of a dual pair of stop projections in the closure tip and in the tubular element is preferable, to allow a rotation of the tubular element that is limited to 180° during the unscrewing operation without hindering the screwing operation. The closure tip 5 externally presents, towards the free end, radial grip projections 54.

With reference to FIGS. 2 and 12, the dispenser 4 is attached onto the cap 2, through the pairs of inner undercuts 43 and 21. In the set of dispenser 4 and cap 2 is inserted the set of body 1 and pushbutton 3 in only one position thanks to the fact that the groove 46 for centering the dispenser is superposed to the centering projection 18 of the body 1, which is inserted in the centering slot 34 of the pushbutton 32 (FIGS. 2, 8, 10). In this assembly position the spout 7 of the dispenser is positioned with its emission conduit 70 in correspondence with the hole 44 of the dispenser and with its coaxial tubular element 71 in correspondence with the notches 45.

A metering chamber is thereby created, formed by the body 1 and by the pushbutton 3 and provided with an intake valve and with an expulsion or delivery valve.

The intake valve is constituted by the seat 13 in the union 12 with the suction tube, by the ball 6 and by the retaining stem 33, which projecting towards the seat of the valve prevents the ball 6 from departing from its seat 13 and, at the same time, prevents pushbutton 3 from bending inwards with its dome 32, making the return stroke of the pushbutton 3 difficult, if not impossible.

The delivery valve is constituted by the tongue 38, created by the "U" shaped cut 36 obtained in the cylindrical wall of the pushbutton 3, and by the omega shaped louver obtained in the pump body 1. The abutting stem 7 serves to prevent the tongue 38 from folding inwards in the metering chamber, which would compromise the operation of the delivery valve as a check valve.

The conduits for compensating for the outflow of the fluid product from the container are constituted by the notches 45, 45 obtained in the dispenser, by the longitudinal slots 37, 37 in the lateral wall 30 of the pushbutton 3 and by the holes 19, 19 of the flanged plate 10 of the body 1. This path places in communication the interior of the bottle or the like, whereon the metering device of the invention is applied, with the exterior.

Therefore in operation, the closure tip 5 is kept unscrewed, with the engagement of first abutting projections 53 of the tip and abutting projections 73 of the spout 7. In this relative position between tip and spout, between the surface of the external body 50 of the tip 5 and the inner surface of the external tubular element 71 of the spout 7 is present an inter-space communicating with the "C" shaped notches 45, 45 of the dispenser. In this way, the compensation conduits between the exterior and the interior of the bottle are kept open. When the pushbutton 3 is pressed, there is a reduction in the volume of the metering chamber and the fluid product contained inside the metering chamber, by the corresponding increase in pressure, is ejected through the spout 7 and the tubular core of the closure tip 5. When the pushbutton returns to the rest position thanks to its elasticity, from the interior of the bottle, through the intake valve, new fluid for the subsequent dispensing is transferred, by depression.

In the periods in which the dispensing device is at rest, the closure tip on the emission conduit is screwed all the way to the head stop.

At the end of the screwing operation, in this relative position between tip and spout, the inter-space between the surface of the external body 50 of the tip 5 and the inner surface of the external tubular element 71 of the spout 7 communicating with the notches 45, 45 of the compensating conduit is closed. The access of air to the interior of the bottle and the undesired exit of the fluid product through the emission conduit are thus prevented. This is obtained by completely screwing the closure tip 5, whose interior extremity comes to bear on the tongue 38 of the delivery valve, preventing it from folding outwards. The screwing of the closure tip 5 is favoured by the presence in its front portion of the radial grip projections 54.

In conclusion, the advantages of the present invention are summarised. This metering device has a reduced number of components (six versus the eleven-twelve of a traditional dispenser), there are substantially no components in relative motion, except for the elastic deformation of the pushbutton, the metering device is also simpler in its utilisation, thanks to ergonomic characteristics connected with the lack of parts in relative motion. The meter is simpler also in its closure, by the simple and immediate rotation of the tip by half a turn. The metering device has a reduced cost of fabrication.

The exterior appearance, which makes its use even more stimulating, should not go unmentioned. Moreover, all components, which are fewer than in traditional metering devices, are made of plastic material and hence more easily recycled.

What is claimed is:

1. A metering device for fluid products, capable of operating as a manually operated reciprocating volumetric pump, having a pump body (1), provided with suction tube and applied by a cap (2) to a container containing a fluid product to be dispensed, comprising:

a elastically deformable pushbutton (3), applied superiorly to pump body (1) and defining therewith a metering chamber provided with an intake valve from the interior of the bottle and a delivery valve towards the exterior of the bottle;

a dispenser (4), mounted on said cap (2) and provided with a spout (7) comprising a conduit (70) for emitting the content of the bottle communicating with the delivery valve;

at least a compensation channel, which replaces the extracted fluid with air coming from the exterior, provided externally to said metering chamber and to said emission conduit (70), for communication between the exterior and the interior of the bottle;

wherein said delivery valve comprises a tongue (38) defined by a U-shaped cut (36) in said pushbutton (3).

2. A metering device for fluid products, capable of operating as a manually operated reciprocating volumetric pump, having a pump body (1), provided with suction tube and applied by a cap (2) to a container containing a fluid product to be dispensed, comprising:

a elastically deformable pushbutton (3), applied superiorly to pump body (1) and defining therewith a metering chamber provided with an intake valve from the interior of the bottle and a delivery valve towards the exterior of the bottle;

a dispenser (4), mounted on said cap (2) and provided with a spout (7) comprising a conduit (70) for emitting the content of the bottle communicating with the delivery valve;

at least a compensation channel, which replaces the extracted fluid with air coming from the exterior, provided externally to said metering chamber and to said emission conduit (70), for communication between the exterior and the interior of the bottle wherein said spout (7) of the dispenser comprises, coaxially external to the emission conduit (70), a tubular element (71) extending the compensation channel;

said tubular extension element (71) being provided with a closure tip (5) having a fusiform body (50) surrounding a longitudinal tubular core (51).

3. A device as claims in claim 2, characterised in that said emission conduit (70) of the spout is threaded internally and said tubular core (51) of the closure tip is threaded externally; the closure tip (5) being able to be screwed on the emission conduit (70) of the spout for the closure of the compensation channel and of the delivery valve.

4. A device as claimed in claim 2, characterised in that said closure tip (5)) externally presents, towards the free extremity, radial grip projection (54) and, facing said external tubular extension element (71), abutting projections (53) serving as stops together with corresponding projections (73) provided on said external tubular extension element (71).

5. A metering device for fluid products, capable of operating as a manually operated reciprocating volumetric pump, having a pump body (1), provided with suction tube and applied by a cap (2) to a container containing a fluid product to be dispensed, comprising:

a elastically deformable pushbutton (3), applied superiorly to pump body (1) and defining therewith a metering chamber provided with an intake valve from the interior of the bottle and a delivery valve towards the exterior of the bottle;

a dispenser(4), mounted on said cap (2) and provided with a spout (7) comprising a conduit (70) for emitting the content of the bottle communicating with the delivery valve;

at least a compensation channel, which replaces the extracted fluid with air coming from the exterior, provided externally to said metering chamber and to said emission conduit (70), for communication between the exterior and the interior of the bottle, wherein said pump body (1) comprises, on one side of a flanged plate (10), a tubular union (12) for the suction tube with a cone frustum shaped portion (13), as a seat of a ball (6) for said intake valve, and coaxially, on the opposite side of said flanged plate (10), a cylindrical element (14) for receiving said pushbutton (3), provided with a squared external lateral portion (15), terminating superiorly with an omega shaped louver (16) comprised in said delivery valve; on said flanged plate (10) being provided at least a through hole (19) comprised in said compensation channel.

6. A metering device for fluid products, capable of operating as a manually operated reciprocating volumetric pump, having a pump body (1), provided with suction tube and applied by a cap (2) to a container containing a fluid product to be dispensed, comprising:

a elastically deform able pushbutton (3), applied superiorly to pump body (1) and defining therewith a metering chamber provided with an intake valve from the interior of the bottle and a delivery valve towards the exterior of the bottle;

a dispenser (4), mounted on said cap (2) and provided with a spout (7) comprising a conduit (70) for emitting the content of the bottle communicating with the delivery valve;

at least a compensation channel, which replaces the extracted fluid with air coming from the exterior, provided externally to said metering chamber and to said emission conduit (70), for communication between the exterior and the interior of the bottle, wherein said cap (2) provided with an interior thread (20) for its screwing onto the bottle, also presents a pair of external undercuts (21) for the attachment thereon of said dispenser (4), without preventing free rotation.

7. A metering device for fluid products, capable of operating as a manually operated reciprocating volumetric pump, having a pump body (1), provided with suction tube and applied by a cap (2) to a container containing a fluid product to be dispensed, comprising:

a elastically deformable pushbutton (3), applied superiorly to pump body (1) and defining therewith a metering chamber provided with an intake valve from the interior of the bottle and a delivery valve towards the exterior of the bottle;

a dispenser (4), mounted on said cap (2) and provided with a spout (7) comprising a conduit (70) for emitting the content of the bottle communicating with the delivery valve;

at least a compensation channel, which replaces the extracted fluid with air coming from the exterior, provided externally to said metering chamber and to said emission conduit (70), for communication between the exterior and the interior of the bottle, wherein said pushbutton (3) has a cupola shape, comprising a cylindrical wall (30) flanged at the base and a spherical dome (32) internally provided with an abutting stem (33) integral with the top of the dome (32) towards said intake valve; in said cylindrical wall (30) being obtained a "U" shaped cut (36) comprised in said delivery valve, and at least a slot (37), positioned according to a generatrix of said cylindrical wall (30) also comprised in said compensation channel.

8. A metering device for fluid products, capable of operating as a manually operated reciprocating volumetric pump, having a pump body (1), provided with suction tube and applied by a cap (2) to a container containing a fluid product to be dispensed, comprising:

a elastically deformable pushbutton (3), applied superiorly to pump body (1) and defining therewith a metering chamber provided with an intake valve from the interior of the bottle and a delivery valve towards the exterior of the bottle;

a dispenser (4), mounted on said cap (2) and provided with a spout (7) comprising a conduit (70) for emitting the content of the bottle communicating with the delivery valve;

at least a compensation channel, which replaces the extracted fluid with air coming from the exterior, provided externally to said metering chamber and to said emission conduit (70), for communication between the exterior and the interior of the bottle, wherein said dispenser (4) inferiorly presents a pair of internal undercuts (43) for the attachment on said cap (2) and laterally a through hole (44) communicating with said emission conduit (70) of the spout and, coaxial thereto, another conduit terminating with at least a "C" shaped notch (45) comprised in said compensation channel.

* * * * *